United States Patent [19]

Lisnyansky

[11] Patent Number: 4,535,950

[45] Date of Patent: Aug. 20, 1985

[54] METHOD AND APPARATUS FOR ROLL WINDING MEASUREMENT

[75] Inventor: Khaim Lisnyansky, Chester, N.Y.

[73] Assignee: International Paper Company, New York, N.Y.

[21] Appl. No.: 570,360

[22] Filed: Jan. 13, 1984

[51] Int. Cl.[3] ..... B65H 17/08

[52] U.S. Cl. ..... 242/66

[58] Field of Search ..... 242/66, 75.51, 75.2, 242/65, 67.5, 67 R

[56] References Cited

U.S. PATENT DOCUMENTS

| | | | |
|---|---|---|---|
| 3,687,388 | 8/1972 | Pfeiffer | 242/65 |
| 3,936,008 | 2/1976 | Crum | 242/75.51 X |
| 4,052,599 | 10/1977 | Whiteley et al. | 242/75.51 X |
| 4,150,797 | 4/1979 | Kataoka | 242/67.1 R |
| 4,232,371 | 11/1980 | Kamoto | 242/75.51 X |
| 4,496,112 | 1/1985 | Olsson et al. | 242/75.51 X |

OTHER PUBLICATIONS

Yogoda, Generalized Formulas for Stress in Wound Rolls, 2-1981, Tappi, vol. 64, No. 2.

Pfeiffer, Internal Pressures in a Wound Roll of Paper, 8-1966, Tappi, vol. 49, No. 8, pp. 342-347.

Pfeiffer, Mechanics of a Rolling Nip on Paper Webs, 8-1978, Tappi, vol. 51, No. 8, pp. 77-85.

Rand, Physical Properties of Newsprint Rolls During Winding, 6-1973, vol. 56, No. 6, Tappi.

Ryti, A Method to Measure the Structure of Newsprint Rolls and its use to Improve Winder Performance, 10-1972, Tappi Finishing Con.

Altmann, Formulas for Computing the Stresses in Center-Wound Rolls, 4/1968, pp. 176-179, vol. 51, No. 4, Tappi.

Eriksson et al, Measurement of Paper Roll Density During Winding, 1/1983, Tappi Journal.

Gangemi, Rider Roll Technology of Two-Drum Winders, 1979, Tappi Finishing Conference.

Pfeiffer, Formulas for Calculating Roll Structures, 1979, Tappi Finishing Conference.

*Primary Examiner*—Stuart S. Levy

*Assistant Examiner*—Lynn M. Sohacki

*Attorney, Agent, or Firm*—Wayne M. Kennard; Charles B. Smith

[57] ABSTRACT

A method and apparatus for continuously measuring the compressive strain and determining the compressive pressure on rolls of flexible material as they are being wound and for measuring the accumulated length of material wound on the roll. An accurate measurement is recorded of the length and caliper of each layer of the roll. From these measurements, the compressive strain and compressive pressure are determined and this information is used to control the winding process. The length measurements are also employed to correct the accumulated length measurement after the winding has been interrupted for removal of defective layers of material.

9 Claims, 4 Drawing Figures

METHOD AND APPARATUS FOR ROLL WINDING MEASUREMENT

BACKGROUND OF THE INVENTION

This invention relates to a method and apparatus for continuously measuring the compressive strain and determining the compressive pressure on rolls of flexible materials as they are being wound and for measuring the accumulated length of material wound on the roll.

In many industries, including papermaking and the manufacture of non-wovens, long, flexible sheets of materials are stored in continuous form by winding the material into rolls. The inherent cohesiveness of the roll and the hardness of the roll, which are developed during the winding process, provide resistance to varying loads and to shock or vibration in transit or while the roll is being unwound.

The two basic forms of winding machinery are center-winders and surface-winders. In center-winding machinery, the roll is entirely supported and driven at the core. Surface winders, which are far more common, are driven externally by one or more powered drums which contact the outside of the roll forming nips through which the material passes as it is wound. In some surface winders, at least one passive rider roll is used in conjunction with the powered drums. The rider roll and two drum configuration illustrated in the drawings is typical of surface winders used in the paper industry.

Roll cohesiveness stems from the internal stresses that are generated within the wound material. Winding results in residual tension and compressive pressure on the material wound in the roll. Ideally, there is a pressure gradient along the radius of the roll with the inner layers being more tightly wrapped than the outer layers. However, the outer layers must be wound tightly enough to provide roll cohesion and the inner layers must not be wound too tightly, or the paper in the roll may be damaged.

Excessive stretch in paper is one of the natural consequences of letting the wound-in tension rise too high. If a high enough tension is applied to a web for a long period of time and subsequently removed, the paper will never return to its original length. Cross-machine variations in the properties of the paper, such as high caliper ridges, will cause high spots in the winding roll and local increases in compressive pressure coupled with local increases in tension. When the paper is later unwound and laid flat, the excess stretched length of the paper in these ridges will cause it to form a series of weaves and puckers in trying to adapt to the less-strained and less-stretched sections of paper nearby.

If the outer layers of a roll of paper have been wound so tightly that the critical level of negative tension in the inner layers has been exceeded, buckling within the roll takes place. Visual indication of this defect is the appearance of the rosette-shaped star winding, without the roll being hit or dropped. (See, J. D. Pfeiffer, "Internal Pressures in a Wound Roll of Paper", TAPPI, Vol. 49, No. 8, p. 342–347, August 1966.).

Roll structure defects due to slippage at or near the core can cause a number of problems at the unwind station of printing presses. Rolls with very loose inner layers can slide sideways, causing a web break. A roll with a very loose core can result in a missed paster. If a roll is wound too soft near the core, it might not be able to support its own weight. See, D. Gangemi, "Rider Roll Technology of Two Drum Winders", TAPPI Finishing Conference, 1979, p. 191–196.

To avoid these roll structure defects, a number of winding control strategies have been developed. Since mathematical equations may be used to predict the compressive pressure and residual tension inside a center-wound roll after winding as a function of the ingoing tension during the winding process, one control strategy is based on measurement of the ingoing tension of a winding roll. See, H. C. Altmann, "Formulas for Computing the Stresses in Center-Wound Rolls", TAPPI, Vol. 51, No. 4, p. 176–179, April 1968; T. Rand and L. G. Eriksson, "Physical Properties of Newsprint Rolls During Winding", TAPPI, Vol. 56, No. 6, p. 153–156, June 1973; J. D. Pfeiffer, "Formulas for Calculating Roll Structure Allow Prediction Roll Defects", TAPPI Finishing Conference, 1979, p. 165–171; H. P. Yagoda, "Generalized Formulas for Stresses in Wound Rolls", TAPPI, Vol. 64. No. 2, p. 91–93, February 1981. By changing the ingoing tension, the compressive pressure and residual tension for optimum roll structure may be obtained, at least in theory. Although this strategy might be realized for center-wound rolls, it faces certain difficulties in the control of the winding process on two-drum surface winders.

It has been shown that the web tension ahead of the winder, the ingoing tension, accounts for only a portion of the total winding tension when pressure rollers or surface winding is used. Another important factor affecting total winding tension on surface winders is nip pressure of the winding drums and the rider roll. As the roll builds up, the increasing weight supported by the winding drums produces higher nip pressure, higher winding tension and a harder roll. See, J. D. Pfeiffer, "The Mechanics of a Rolling Nip on Paper Webs", TAPPI, Vol. 51, No. 8, p. 77A–85A, August 1968, which is herein incorporated by reference. There is no known technology which can measure the actual web tension after the nip in surface winders, thus roll structure control on that basis is not practical.

An alternate winding control strategy could be developed by measurement of the actual compressive pressure or compressive strain in the roll during the winding process. However, because internal compressive pressure is difficult to measure during winding, this variable cannot be used directly to control the winding process. One approach sought to overcome this problem by monitoring the density of the paper on the roll, a more easily measurable roll property which is related to the internal compressive pressure. During winding the average density of a band of paper on the roll is determined by measuring the number of layers in the band and the thickness of the band, then calculating the mean thickness of the paper and its mean density. See, L. G. Eriksson, C. Lydig, J. A. Viglund and P. Komulainen, "Measurement of Paper Roll Density During Winding," TAPPI, Vol. 66, No. 1, pp. 63–66, January 1983. The resolution of this method is limited because it depends on the number of layers used as the basis for determining the mean density, and 20 to 400 layers are required for a measurement. Moreover, this method does not take into account changes in the caliper of the paper before winding, which limits the accuracy of its measurements. These two limitations are disadvantages especially in winding control for newsprint or other papers used on printing machinery where proper roll structure is important to ensure that a roll will run properly after shipping, storage and handling.

In addition to the problem discussed above, a problem exists in measuring the accumulated length of material on a roll during winding. Sometimes, the winding process must be stopped because of the poor quality of the structure of the wound roll, e.g., a low hardness of the roll. When this happens, a number of roll layers have to be removed and the cut edges spliced before winding can be restarted. The measurement of the material length is stopped and the diameter of a roll is noted before cutting and removal of the poor layers of the roll. The length measurement is restarted after the previously noted diameter is once again obtained. In this case, an error in the length measurement is made because one cannot wind a roll the second time with the same hardness as the first time. The proper method of length measurement would be to determine the actual length of material in the wound roll after removal of the defective layers, rather than to approximate the length by measuring of the roll diameter and introducing an error by assuming identical roll structure.

SUMMARY OF THE INVENTION

The present invention solves the problem of determining compressive strain and the the internal compressive pressure of a roll during winding. At the same time, the present invention also solves the problem of accurately correcting the accumulated length measurement after defective layers are removed. An accurate measurement is recorded of the length and thickness of each layer of the roll. From these measurements, the compressive strain is determined and continuously monitored during winding. In turn, the internal compressive pressure, a function of the compressive strain, is determined, and this information is used to control the winding process in order to build the proper roll structure.

Compressive strain is determined from the difference between the actual thickness of the layers of material on the roll and the theoretical thickness of layers of material wound with no compressive strain. The actual thickness of the layers of material on the roll is obtained by accurately measuring the length of material in each layer on the roll and hence the diameter of each layer. The thickness of a band comprising a number of layers can be calculated from the difference of the diameters of its inner and outer layers.

By continuously measuring the thickness of the material before it is wound onto the roll, variations in the thickness of the material can be taken into account in determining the compressive strain, increasing the accuracy of the measurement. This results in improved roll structure control and fewer rejected rolls.

A second aspect of the invention is the capability for accurately correcting the measurement of the accumulated length of material on a roll after some portion has been removed because of defects. The operation is based on recording the accurate measurement of the length of each layer made during winding and the summation of those measurements to determine the total length of material on the roll. After removal of a defective section, when winding is resumed the length of the first layer is measured. The total length calculation is set back to its value at that layer and the summation resumes from that point.

In a wound roll of material the internal compressive pressure, $P_c$, is a function of the compressive strain, $\epsilon_c$, according to the following equation (equation 1):

$$P_c = K_1 \exp(K_2 \epsilon_c) - K_1$$

wherein $K_1$ is the pressure on the roll when the strain is reduced to zero, and $K_2$ is the springiness factor of the material. The values for $K_1$ and $K_2$ can be determined by experiment and are constant for a given type of material.

The compressive strain of a band of n layers of material on a roll can be determined as the ratio (equation 2):

$$\epsilon_c = \frac{\Delta D_o - \Delta D_x}{\Delta D_o}$$

wherein $\Delta D_o$ is the incremental diameter of the n layer band with the compressive pressure reduced to zero and $\Delta D_x$ is the actual incremental diameter of the n layer band wound under compressive pressure. $\Delta D_o$ can be obtained by summing the actual thickness of each of the n layers wound. $\Delta D_x$ can be determined from the actual measurements of the length of the first layer, $l_i$, and last layer, $l_n$, in the band according the following equation (equation 3):

$$\Delta D_x = D_n - D_i = \frac{l_n - l_i}{\pi}$$

Thus from a measurement of the length of the individual layers during winding of a roll, the compressive strain $\epsilon_c$ and in turn the internal compressive pressure $P_c$ can be determined.

A winding control strategy is implemented based on the internal compressive pressure determination. Given the desired compressive pressure profile for producing optimum roll structure, roll winding parameters, eg, web tension, rider roll pressure, and winding drum torque, are controlled during winding so that the measured compressive pressure in the roll follows the desired pressure profile.

DESCRIPTION OF THE DRAWINGS

In order to more fully describe the invention, the following drawings are provided, in which.

DETAILED DESCRIPTION OF THE INVENTION

Figure 1:
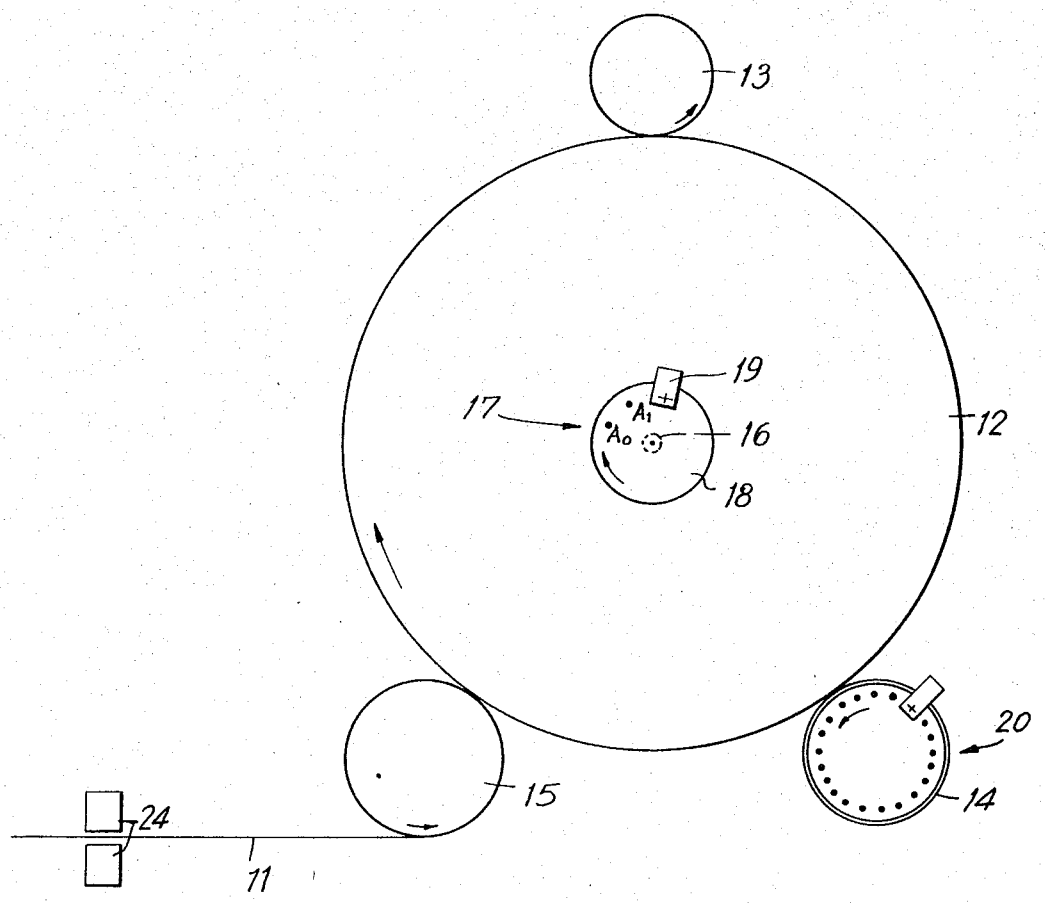
FIG. 1 shows a schematic diagram of a two drum winder incorporating the present invention.

FIG. 1 shows a schematic diagram of a two drum winding system which employs a preferred embodiment of the present invention. A paper web 11 is being wound on a roll 12, loaded by rider roll 13 and driven by driving drums 14 and 15. Roll core 16 is located at the center of roll 12. Driving drums 14 and 15 rotate counter clockwise to drive roll 12 clockwise. Paper web 11 passes around drum 15 and onto the outside of roll 12.

The compressive pressure in roll 12 is caused by the tension in web 11 during winding and the nip load between roll 12 and drums 14 and 15.

A pulse encoder 17 is mounted on roll 12. Pulse encoder 17 consists of plate 18 solidly connected to roll core 16, and pulse detector 19 mounted stationary close to the surface of plate 18. Plate 18 has two labels, $A_0$ and $A_1$, and as plate 18 rotates pulse detector 19 emits a pulse when $A_0$ and $A_1$ move past it. Magnetic, capacitive or optical devices may be used for pulse encoder 17. Such devices are well known and the choice of a particular type is not critical to the present invention.

Figure 2:
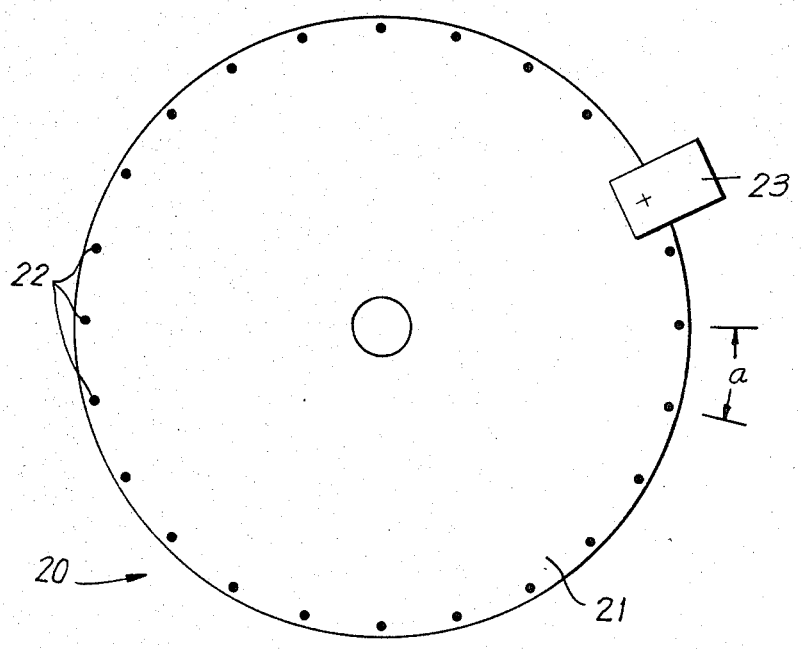
FIG. 2 shows a more detailed diagram of one of the pulse encoders shown in FIG. 2.

A second pulse encoder 20 is mounted on and rotates with driving drum 14. Alternatively, pulse encoder 20 could be mounted on a separate shaft or drum adjacent to the path of paper web 11 and in contact with web 11 so that web 11 drives pulse encoder 20. Pulse encoder 20, shown schematically in FIG. 2, consists of rotating plate 21 and pulse detector 23 mounted stationary close to the surface of plate 21. Plate 21 has a number of pulse labels 22, equally spaced around its circumference. The spacing between the labels 22 is such that the distance between labels $A_0$ and $A_1$ is more than twice the distance between the labels 22 on plate 21 but less than three times the distance between the labels 22 on plate 21. As plate 21 rotates, pulse detector 23 emits a pulse each time one of the labels 22 moves past it. Like pulse encoder 17, pulse encoder 20 can be a magnetic, capacitive or optical device.

Also mounted along the path of paper web 11 is caliper meter 24, which measures the thickness of the paper web moving past it. Alternatively, if there is no significant variation in the thickness of the material it may be possible to omit caliper meter 24 and to substitute a constant value signal representing the thickness of the material.

At the beginning of the winding process, a start signal is generated when label $A_0$ moves past pulse detector 19. Thereafter, for every revolution of roll 12, the thickness, h, and the length, l, of the layer of material wound onto the roll are measured and recorded in a suitable memory. In addition the individual layer lengths are summed to obtain a total length measurement, L, for each layer, also stored in memory.

Figure 3:
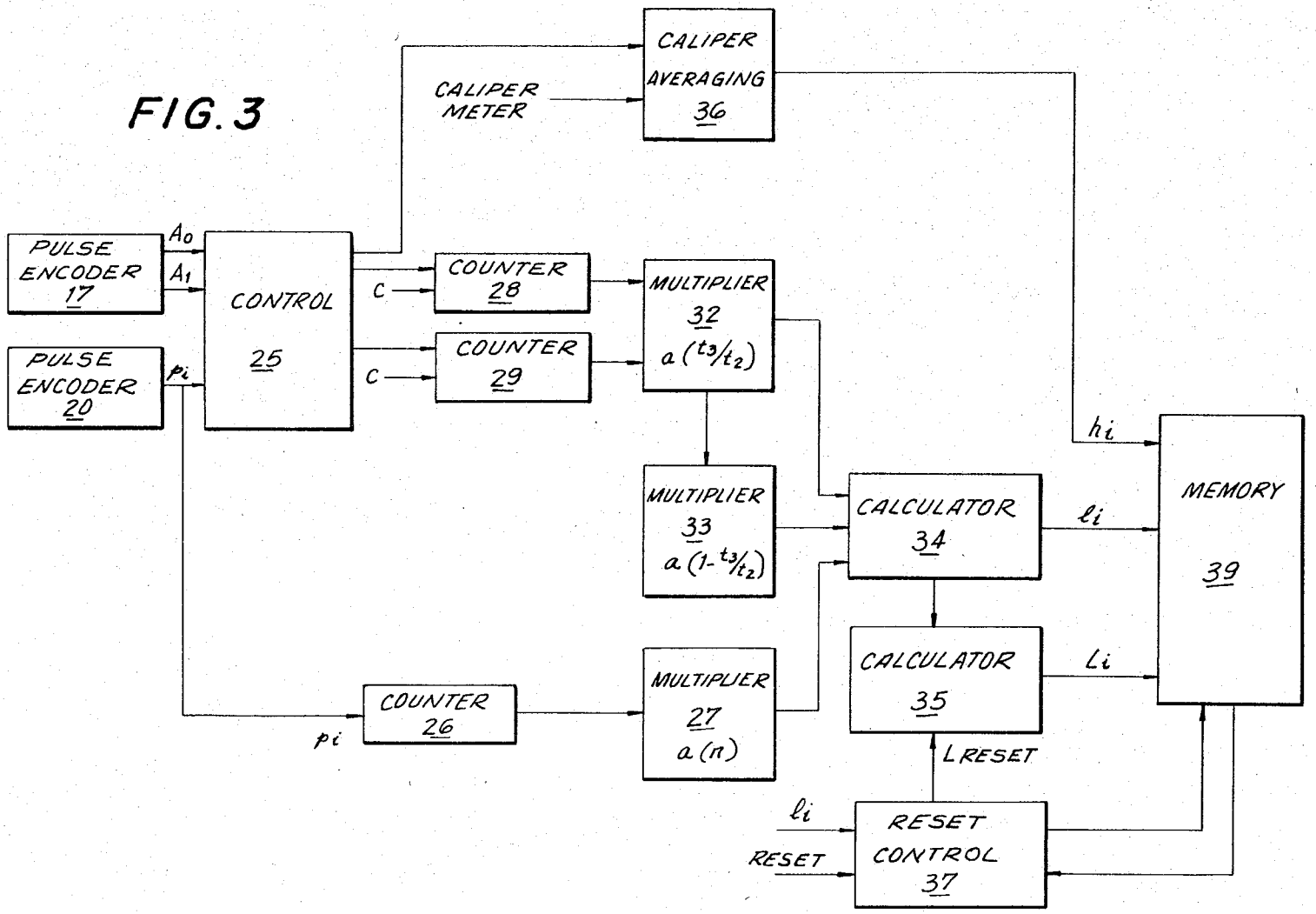
FIG. 3 shows a schematic block diagram illustrating the operation of a portion of the system.

The thickness and length measurements for each layer, and the accumulated length measurement are carried out by processor 30, which receives the signals from pulse encoders 17 and 20 and from caliper meter 24. FIG. 3 shows a schematic block diagram illustrating the operation of processor 30.

The length of each layer is determined from the signals generated by pulse encoder 17 and pulse encoder 20. The beginning of a revolution, and thus the start of each new layer, is signalled. by a pulse from label $A_0$. At that signal control 25 causes counter 26 to start to count the number of pulses from pulse encoder 20.

The count of pulses n accumulated by counter 26 represents the number of whole length units in the layer, where each length unit is the distance, a, along the circumference of plate 21 between two consecutive pulse labels 22. Control 25 sends the counter 26 count to multiplier 27 which multiplies n times a to obtain the whole length unit result. This result is sent to calculator 34, whose operation is described below.

The fractional length unit at the end of the rotation must also be determined. Near the end of one revolution of the roll and the completion of one layer, label $A_1$ moves past pulse detector 19.

The signal from label $A_1$ provides notice to control 25 that a revolution is almost complete. At the next signal from pulse encoder 20, label $p_i$, control 25 starts counter 28 which counts pulses C from a clock pulse generator. At the next signal from pulse encoder 20, label $p_{i+1}$, control 25 stops counter 28 and starts a second counter 29 which also counts pulses C from the clock pulse generator. At any succeeding signal from pulse encoder 20 before the $A_0$ signal is received, control 25 stops counter 29, replaces the value in counter 28 with the value in counter 29, resets counter 29 and restarts counter 29. Thus, the value in counter 28 is updated to represent the clock pulse count between the two most recent "p" labels. As the diameter of roll 12 increases, the number of pulses from pulse encoder 20 which occur between the $A_1$ and $A_0$ signals also increases. Because of the ratio of the distance between the labels p to the distance between the labels $A_1$ and $A_0$, at least two pulses from pulse encoder 20 occur between the $A_1$ and $A_0$ signals for the minimum roll diameter at the start of a roll.

When the signal from label $A_0$ is received from pulse encoder 17, control 25 stops counter 29. The ratio of the value in counter 29, $t_3$, to the value in counter 28, $t_2$, is the ratio of the fractional length unit to a whole length unit. Control 25 causes multiplier 32 to multiply this ratio times one length unit, a. The fractional length unit result, $a(t_3/t_2)$, is sent to calculator 34. The fractional length unit result is also sent to multiplier 33 to determine the fractional length unit at the beginning of the next rotation, $a(1-t_3/t_2)$, which must be added to the length of the next layer.

Calculator 34 sums the results of multiplier 27 and multiplier 32 for the current rotation and the result of multiplier 33 for the last rotation to determine the length $l_i$ of the current rotation. Thus, in general, the length $l_i$ of the layer is the fractional length unit at the beginning of the rotation plus a number of whole length units plus the fractional unit at the end of the rotation.

The length $l_i$ is sent to memory 39 for storage and also sent to calculator 35 to calculate $L_i$, the accumulated length from the beginning of the winding process. The value $L_i$ is also sent to memory 39 for storage.

Finally, at each $A_0$ pulse, control 25 causes averaging circuit 36 to send the average caliper value $h_i$ for the layer to memory 39 for storage.

Thus, after n layers, a matrix of values is accumulated in memory 39 in the form:

$h_1, h_2, h_3 \ldots h_i \ldots h_n$ $l_1, l_2, l_3 \ldots l_i \ldots l_n$ $L_1, L_2, L_3 \ldots L_i \ldots L_n$ As the material is being wound onto roll 12, compressive strain and compressive pressure calculations are carried out by calculator 40, based on the data stored in memory 39 and using equations 1, 2 and 3 as explained above. The number of layers used in each determination of the compressive strain and compressive pressure can be selected by the operator. The results of the calculations are sent to winder control 41. See FIG. 4.

Winder control 41 compares the measured compressive pressure value to a predetermined progression of values fed into winder control 41 by the operator before beginning the winding process. The predetermined values may be determined empirically by measuring the compressive pressure in properly wound rolls. Alternatively an ideal compressive pressure profile may be used to establish a predetermined progression of compressive pressure values for optimum roll structure. Such ideal compressive pressure profiles have been discussed in the literature, e.g. J. D. Pfeiffer, "Internal Pressures In A Wound Roll Of Paper", TAPPI, Vol. 49, No. 8, pp. 342–47, August 1966; N. Ryti, E. Jalkanen, V. Sarkela and P. Komulainen, "A Method To Measure The Structure Of Newsprint Rolls And Its Use To Improve Winder Performance", TAPPI Finishing Conference, 1972, pp. 61–70. If the measured compressive pressure value differs from the predetermined compressive pressure value, winder control 41 adjusts one or more winding parameters to cause the compressive pressure to return to the predetermined value. Among the winding parameters which can be adjusted are the tension of web 11, the pressure of rider roll 13 and the torque of driving drums 14 and 15.

The second aspect of the invention is correcting the accumulated length measurement, L, after the winding has been interrupted to remove defective outer layers from the roll. This is accomplished by determining the length of a newly-wound layer, searching memory for that length and the corresponding accumulated length measurement, and resuming the layer-by-layer summation at that value.

Figure 4:
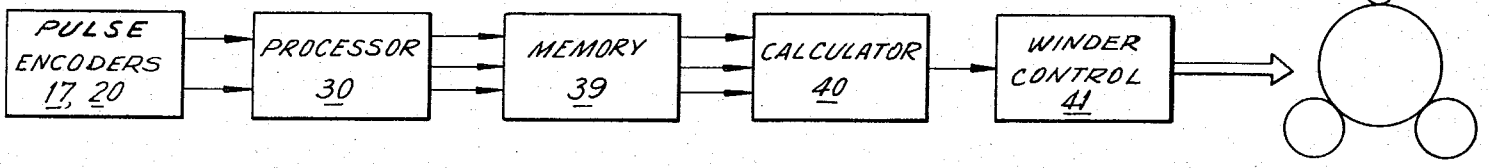
FIG. 4 shows a schematic diagram of a winder control system embodying the present invention.

The operation of the reset control circuit is schematically illustrated in FIG. 4. When winding is interrupted, the operator sends a reset signal to processor 30, by, for example, depressing a switch. When winding resumes, processor 30 sends the $l_i$ measurement for a newly-wound layer, $l_{reset}$, to reset control 37, and transfers control to reset control 37. Reset control 37 searches memory 39 for the $l_i$ value closest to $l_{reset}$ and for the corresponding accumulated length measurement, $L_{reset}$. Then reset control 37 replaces the current $L_i$ value in calculator 35 with $L_{reset}$, and erases from memory 39 the $l_i$, $L_i$ and $h_i$ values for layers subsequent to the $l_{reset}$ layer. Reset control 37 then returns control of the process to control 25 and the normal measurements are resumed at the proper accumulated length value.

Other variations and modifications will be apparent to those skilled in the art, and the claims are intended to cover all such variations and modifications as fall within the true spirit and scope of the invention.

I claim:

1. Apparatus for measuring the length of successive layers of a web of flexible material wound on a roll by a winder, for determining the compressive strain on the web of flexible material and for determining the accumulated length of the material which has been wound onto the roll, which comprises:

first pulse encoder means for generating signals representing a first portion of a rotation and a second portion of a rotation of the roll onto which the material is wound, second pulse encoder means for generating signals representing the length of material being wound onto the roll, processor means, responsive to said signals from said first and second pulse encoders, which measures for each revolution of said roll the length of material wound onto the roll during that revolution and the accumulated length of material wound onto the roll from the start of the roll, memory means for storing said length measurements for each revolution and said accumulated length measurements, means for deriving signals indicative of said length measurements for each revolution, means for combining and transforming said indications into a further indication of the compressive strain on at least one layer of the material wound onto the roll, and reset control means for correcting the accumulated length measurement after at least one defective layer of material has been removed from the roll.

2. The apparatus of claim 1 wherein the processor means comprises:

first multiplier means for determining the number of whole length units included in the length measurement for each revolution, based on the number of pulses in the signal generated by the second pulse encoder means, second multiplier means for determining the fraction of the length unit at the end of each revolution to be included in the length measurement for that revolution, based on the signals generated by the first and second pulse encoder means, and third multiplier means for determining the fraction of the length unit at the end of each revolution to be included in the length measurement for the next revolution, based on the determination made by the second multiplier means.

3. The apparatus of claim 1 wherein the reset control means is responsive to a reset signal from the operator so that after winding resumes the reset control receives the length measurement for a revolution, searches the memory means for the stored length measurement and the stored accumulated length measurement corresponding to the length measurement after the reset signal, and sends that accumulated length measurement to the processor means to correct the accumulated length measurement.

4. The apparatus of claim 1 further comprising:

caliper means for generating signals representing the thickness of the material being wound onto the roll, said processor means being responsive to the signals from said caliper meter and measuring the average thickness for each revolution of said roll, said memory means storing said thickness measurement for each revolution, and means for deriving tangible indications of said thickness measurements for each revolution, said means for combining and transforming operating on said indications of said thickness measurements and on said indications of said length measurements.

5. The apparatus of claim 1 wherein the winder is a two drum winder.

6. The apparatus of claim 1 wherein the flexible material is paper.

7. Apparatus for controlling a winder for winding a web of flexible material on a roll which comprises:

first pulse encoder means for generating signals representing a first portion of a rotation and a second portion of a rotation of the roll onto which the material is wound, second pulse encoder means for generating signals representing the length of material being wound onto the roll, processor means, responsive to said signals from said first and second pulse encoders, which measures for each revolution of said roll the length of material wound onto the roll during that revolution and the accumulated length of material wound onto the roll from the start of the roll, memory means for storing said length measurements for each revolution and said accumulated length measurements, means for deriving signals indicative of said length measurements for each revolution, means for combining and transforming said indications into a further indication of the compressive strain on at least one layer of the material wound onto the roll, and means responsive to said compressive strain indication for adjusting continuously at least one operating parameter of said winder such that the compressive strain is maintained at a progression of predetermined values as said flexible material is wound onto the roll.

8. A method for controlling a winder for winding a web of flexible material on a roll, said method comprising:

measuring the length of each layer of said flexible material as it is applied to the roll, deriving a signal indicative of said length measurements for each revolution, combining and transforming said indications into a further indication of the compressive strain on at least one layer of the material wound onto the roll, and adjusting continuously at least one operating parameter of the winder as a function of said compressive strain indication such that the compressive strain is maintained at a progression of predetermined values as said flexible material is wound onto the roll.

9. The method claim 8, further comprising:

measuring the thickness of said flexible material in each layer as it is applied to the roll, deriving a signal indicative of said thickness measurements, and combining and transforming said indications of said thickness measurements and said indications of said length measurements into said further indication of the compressive strain on at least one layer of the material wound onto the roll.

* * * * *

UNITED STATES PATENT AND TRADEMARK OFFICE

CERTIFICATE OF CORRECTION

PATENT NO. : 4,535,950

DATED : August 20, 1985

INVENTOR(S) : Khaim Lisnyansky

It is certified that error appears in the above-identified patent and that said Letters Patent is hereby corrected as shown below:

Col. 1, line 47, "caliper" should be -- thickness --.

Col. 5, line 51, after "signalled" delete --.--.

Signed and Sealed this

Twenty-fourth Day of November, 1987

*Attest:*

DONALD J. QUIGG

*Attesting Officer*

*Commissioner of Patents and Trademarks*